United States Patent [19]

Shadrach III et al.

[11] Patent Number: 4,872,555

[45] Date of Patent: Oct. 10, 1989

[54] CARTON INCLUDING DETACHABLE COUPON

[75] Inventors: William S. Shadrach III, Atlantic Highland; Michael Mandler, Woodcliffe Lake; Ihor D. Moch, Lebanon; Bernard Zitomer, East Brunswick; John L. Stewart II, Manalapan, all of N.J.

[73] Assignee: Sunshine Biscuits, Inc., New York, N.Y.

[21] Appl. No.: 109,386

[22] Filed: Oct. 15, 1987

Related U.S. Application Data

[63] Continuation of Ser. No. 948,171, Dec. 31, 1986, abandoned.

[51] Int. Cl.[4] ..... B65D 5/42

[52] U.S. Cl. ..... 206/459; 206/831

[58] Field of Search ..... 206/459, 612, 831; 229/118, 132, 136, 155, 16 R; 40/312

[56] References Cited

U.S. PATENT DOCUMENTS

| | | | |
|---|---|---|---|
| 911,884 | 2/1909 | Kyle | 206/831 |
| 1,269,918 | 6/1918 | Fietsch, Jr. | 229/3.1 |
| 2,672,273 | 3/1954 | Smith | 206/831 |
| 3,183,614 | 5/1965 | Coderhose | 206/831 |
| 3,455,497 | 7/1969 | Gilliam | 206/831 |
| 3,606,135 | 9/1971 | Rosenburg, Jr. | 206/831 |
| 3,946,937 | 3/1976 | Forbes, Jr. et al. | 206/621 |

FOREIGN PATENT DOCUMENTS

| | | | |
|---|---|---|---|
| 664202 | 6/1963 | Canada | 206/612 |
| 2210301 | 9/1973 | Fed. Rep. of Germany | 206/459 |

*Primary Examiner*—Gary Elkins

*Attorney, Agent, or Firm*—Owen, Wickersham & Erickson

[57] ABSTRACT

A carton formed from a carton blank in which an end closure comprises at least three flaps hingedly connected to the carton front, back, and side walls, including the major flaps opposite one another and a minor flap having printing or other marking thereon for detachment as a coupon or for the commercial use. The minor flap carrying the printing or marking extends a substantial distance into the end closure opening.

3 Claims, 2 Drawing Sheets

CARTON INCLUDING DETACHABLE COUPON

This is a continuation of application Ser. No. 948,171, filed Dec. 31, 1986, now abandoned.

BACKGROUND OF THE INVENTION

Cartons made from one-piece blanks with a coupon included as part of the blank have been proposed (see U.S. Pat. Nos. 3,606,135 and 3,625,412).

Coupons have been included as part of a major top closure flap (U.S. Pat. No. 3,606,135) and have been attached to, but not forming a part of, essential structural elements of cartons such as walls, sides or closure flaps (U.S. Pat. No. 3,625,412).

Removable flap portions for use in a top section of a cardboard receptacle have been proposed (U.S. Pat. No. 2,265,664). Mailing tags have been foldedly positioned against the outside wall of a film carton (U.S. Pat. No. 2,359,679) and coupons have been illustrated as placed in and as part of the carton walls (U.S. Pat. No. 3,219,253).

SUMMARY OF THE INVENTION

Broadly, the invention comprises a cardboard carton formed from a carton blank in which an end closure comprises at least three (3) flaps hingedly connected to the carton's front, back and side walls including the major flaps opposite one another and a minor flap having printing or other markings thereon for detachment and after-use as a coupon or for other commercial use.

It is a feature that the minor flap carrying the markings for commercial use extends a substantial distance into the end closure opening.

DESCRIPTION OF THE PREFERRED EMBODIMENT

Figure 1:
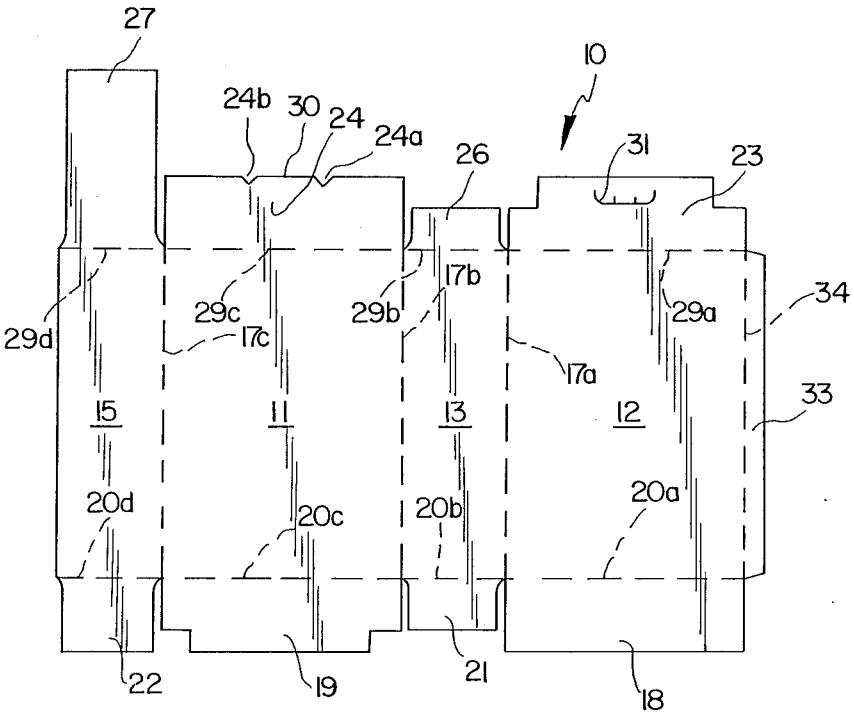
FIG. 1 is a plan view of the carton blank.

Referring to FIG. 1, carton cardboard blank 10 includes front panel 11, back panel 12, first side panel 13 and opposite second panel 15, all connected by crease hinge lines 17*a*, 17*b*, and 17*c*. Also shown is major rectangular bottom flap 18, notched bottom flap 19 and bottom minor flaps 21, 22. Bottom flaps 18, 19, 21, and 22, which cooperate to form bottom end closure, are attached to the back, front and side panels along crease lines 20*a*, 20*b*, 20*c* and 20*d*. Top closure flaps include top major square-notched flap 23, V-shaped notched major flap 24 including V-notches 24*a* and 24*b*, short minor flap 26 and coupon extended minor flap 27. Crease hinge lines 29*a*, 29*b*, 29*c*, and 29*d* connect top flaps to the front, back and side panels. Turn-under locking tab 30 formed between V-notches 24*a* and 24*b* is insertable into U-shaped slit 31 in flap 23. Also shown is glue tab 33 connected to panel 12 along crease line 34.

Figure 3:
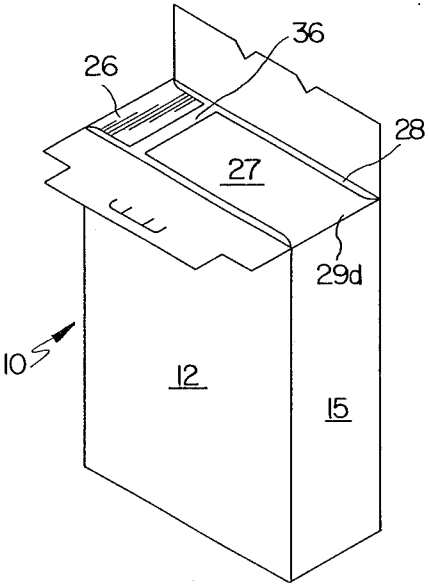
FIG. 3 is a perspective view of the blank assembled with the top end closure arrangement open.
Figure 2:
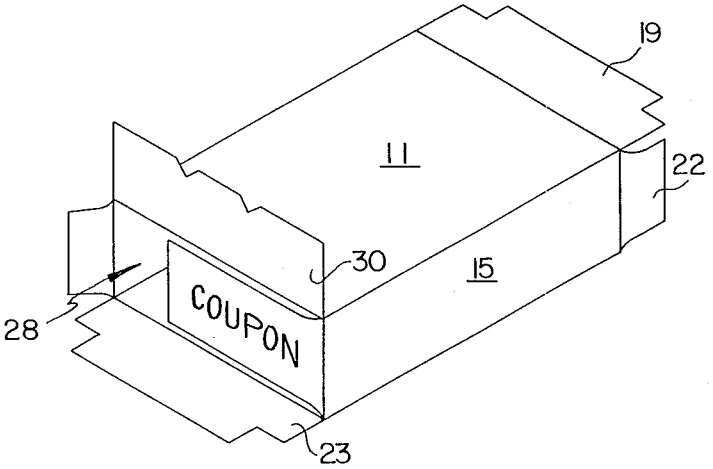
FIG. 2 is a perspective view of the blank partially assembled with both ends open.

Turning to FIGS. 2 and 3, it is seen that short top minor flap 26 and coupon flap 27 extend substantially into and across the top opening 28 with coupon flap 27 extending substantially more than halfway across opening 28 (FIG. 3). Flaps 26 and 27 are separated by a gap 36. Alternatively, coupon flap 27 may extend less than halfway across opening 28, for example, one-third the way across.

Coupon flap 27 may have printed or otherwise marked on it a coupon, premium, "cents-off" statement or other commercial information for use by the consumer or purchaser upon opening of the carton and removal of flap 27 (or portion thereof) along crease line 29*d* or other location by cutting, tearing or other removal. Commercial information or coupon flap 27 is readily removable in that only one of its four sides requires cutting or tearing.

The carton may contain a bag or liner for holding the contents of the carton such as crackers, cereal or other product. Alternatively, the carton may be the primary package (without use of a bag or liner) to hold cereal or other products. It is seen that upon opening the major top flap the coupon flap 27 is exposed to view drawing attention to itself.

We claim:

1. A carton assembled from a carton blank having a front panel, a back panel, and side panels, which blank as assembled has an opening closable by an end closure unit comprising:

(a) a major first flap hingedly connected to the front panel along a first hinge line;

(b) a second major flap hingedly connected to the back panel along a second hinge line;

(c) a minor third flap hingedly connected to one side panel along a third hinge line and extending into the top opening from said one side panel;

(d) a redeemable commercial information panel underlying the major flaps when closed and removably attaching to and extending from the other side panel into said opening a substantial distance; and (e) means for allowing re-closing of the major flaps;

wherein said commercial information panel is removable in absence of tearing any of said first, second, and third flaps along said first, second and third hinge lines;

wherein removal of said commercial information panel is accomplished without destroying the assembled carton so as to permit subsequent re-closing of said end opening; and wherein said commercial information panel can be removed and presented for redemption while said carton is being used.

2. The carton of claim 1 in which the commercial information panel extends substantially more than halfway across the top opening.

3. The carton of claim 1 in which the top minor flap and the commercial information flap are separated in their closed position by a gap.

* * * * *